US006073369A

United States Patent [19]

Yasuyuki

[11] Patent Number: 6,073,369

[45] Date of Patent: Jun. 13, 2000

[54] SUBSTRATE DRYING APPARATUS AND METHOD

[75] Inventor: Satou Yasuyuki, Tokyo, Japan

[73] Assignee: NEC Corporation, Tokyo, Japan

[21] Appl. No.: 09/049,150

[22] Filed: Mar. 27, 1998

[30] Foreign Application Priority Data

Mar. 31, 1997 [JP] Japan ..... 9-079886

[51] Int. Cl.[7] ..... F26B 9/00

[52] U.S. Cl. ..... 34/651; 34/381

[58] Field of Search ..... 34/381, 414, 422, 34/629, 630, 638, 651

[56] References Cited

U.S. PATENT DOCUMENTS 4,077,137 3/1978 Edgington et al. ..... 34/70

5,115,926 5/1992 Lymn ..... 34/155

*Primary Examiner*—Henry Bennett
*Assistant Examiner*—Malik N. Drake
*Attorney, Agent, or Firm*—Whitham, Curtis & Whitham

[57] ABSTRACT

A carriage mechanism for horizontally carrying a rectangular shaped substrate and a gas injection mechanism for jetting a gas toward both upper and lower surfaces of the carried rectangular shaped substrate are provided and an air from a gas injection port is jetted on the substrate toward a center portion from both ends of the substrate, wherein by means of the high pressured air jetted from the gas injection port of the gas injection mechanism, droplets are collected from both end surfaces of the substrate and collected at the center portion of the substrate where the air concentrates, and the collected droplets are blown away from the end surfaces of the substrate with the help of surface tension of the substrate also.

13 Claims, 6 Drawing Sheets

SUBSTRATE DRYING APPARATUS AND METHOD

BACKGROUND OF THE INVENTION

The present invention relates to a technology for drying a substrate and more particularly to a technology for drying a substrate using an air knife.

Conventionally, in a manufacturing process of a liquid crystal device, a color filter, a photo-mask and so forth, such a kind of substrate drying method is used for drying a rectangular shaped substrate of which surface has been treated in a wet manner of every kind such as a substrate cleaning treatment, and is applied to work for removing droplets attached to the rectangular shaped substrate and drying the substrate.

As a liquid cutting device for removing droplets attached to a rectangular shaped substrate, for example, the device described in JP-A-338686-1996 and the device described in JP-A-302779-1995 are known. The conventional example described in JP-A-302779-1995 will be explained based on FIG. 7 and FIG. 8.

The conventional device shown in FIG. 7 and FIG. 8 comprises a carriage mechanism 110 for horizontally carrying a rectangular shaped substrate W, a first gas injection mechanism 120 for jetting a gas toward both upper and lower surfaces of the rectangular shaped substrate W being carried, and a second gas injection mechanism 130 for jetting a gas toward both upper and lower surfaces of the rectangular shaped substrate W backward from the first gas injection mechanism 120.

Up-and-down air knives 121 of the first gas injection mechanism 120 are placed so that the knife has a slant to a direction orthogonal to a direction of the carriage, and each up-and-down air knife 131 of the second gas injection mechanism 130 is placed so that the knife has a slant in a direction opposite to a direction of that of each up-and-down air knife 121 of the first gas injection mechanism 120 and is constructed so as to finally remove droplets by the second gas injection mechanism 130, which have remained at a corner portion of the rectangular shaped substrate W without being blown away by the first gas injection mechanism 120.

An arrangement of the conventional drying method comprises, as shown in FIG. 8, the first gas injection mechanism 120 and the second gas injection mechanism 130. A condition of removing droplets of the rectangular shaped substrate W is shown in FIG. 9. In order to facilitate to remove the droplets (shown by oblique lines in FIG. 9) of the rectangular shaped substrates W, each gas injection mechanism is placed so as to be in the shape of a Japanese letter 八 in a horizontal plane and so as to have a slant to a direction orthogonal to a carriage direction of the rectangular shaped substrate W. At first, the droplets that have been swept away and remained at a corner portion of the rectangular shaped substrate W by the first gas injection mechanism 120 remains at a corner portion X of the rectangular shaped substrate W. The remaining droplets are removed in a manner that liquid X at the corner portion of the rectangular shaped substrate that has not been removed by the first injection mechanism is blown away while being swept along an end surface of the substrate from the corner portion of the rectangular shaped substrate by the second gas injection mechanism 130. Regardless of the arrangement in which the droplets attached to the surface of the substrate is completely removed, the droplets X that has been driven into the corner portion of the substrate W are not completely removed and remain stained (as a local thin film) since, in case of some kinds of a substrate, the droplets are not blown away from the end surfaces of the substrate and an attachment force to the rectangular shaped substrate W is increased.

Also, the droplets X that have been swept away once by the first injection mechanism follow the substrate end surfaces of the rectangular shaped substrate W, and by following the substrate end surfaces by means of the second gas injection mechanism again, the droplets swallow up particles of the substrate end surfaces to form a stain. Then, the stain peels during a manufacturing process and becomes the cause of particles or is a hindrance to making an element on the substrate. Also, since it is necessary to set two air knives, an area for setting becomes to be large. In fabricating a device, a cost of the device also goes up. Further, since an amount of use of an air being supplied to the two air knives becomes to be twice compared with the conventional case of one air knife, a cost of required power becomes to be twice.

SUMMARY OF THE INVENTION

The objective of the present invention is to provide a technology for drying a substrate, which is capable of preventing pollution such as remaining droplets from remaining at a peripheral corner portion and an end surface portion of a substrate by conducting a liquid cutting dry treatment for both surfaces of the substrate by means of an air knife to droplets attached to the surfaces of the rectangular shaped substrate to which a wet surface treatment has been applied.

Moreover, the objective of the present invention is to provide a technology for drying a substrate, which is capable of completely removing droplets attached to an upper surface of the substrate that is horizontally carried and in which the droplets do not enter a treatment reservoir at a backward stage.

The further objective of the present invention is to provide a technology for drying a substrate, which is capable of making a space for setting to be smaller by providing one injection mechanism which replaces two injection mechanisms capable of completely removing the droplets attached to the upper surface of the substrate that is horizontally carried.

In order to achieve the above-described objectives, a substrate drying apparatus of the present invention has carriage means and a gas jet stream mechanism and is for spraying a gas on surfaces of a rectangular shaped substrate to which a wet surface treatment has been applied, removing droplets on the substrate surfaces, and drying the substrate, and in the substrate drying apparatus, the carriage means is for carrying the above-described substrate with the surfaces of the substrate of an object to be treated oriented toward a gas injection section, the gas jet stream mechanism has a slit shaped gas injection port for jetting a gas toward the surfaces of the substrate carried by the above-described carriage means, and the above-described slit shaped gas injection port is an opening toward directions along which droplets are pushed aside from both sides of end portions of the substrate to a center portion.

Also, the above-described slit shaped gas injection port of the gas jet stream mechanism is constructed of a linear portion arranged in a direction orthogonal to a direction along the carriage of the substrate and bent portions bending from and connected to both ends of the above-described linear portion.

And, the above-described slit shaped gas injection port of the gas jet stream mechanism curves in the shape of a semicircular arc.

And, the above-described slit shaped gas injection port of the gas jet stream mechanism is bent in the shape of a Japanese letter < at a center portion of the substrate.

In accordance with the substrate drying apparatus of the present invention, an air from a gas injection mechanism is jetted toward the center portion from both ends of the substrate. Thereby, droplets attached to the rectangular shaped substrate W are blown away toward an opposite side to a direction along the carriage of the substrate and, at the same time, the droplets are pushed up on both surfaces of the substrate from both edge sides of the substrate.

Furthermore, as shown in FIG. 4, droplets pushed up from end surfaces, an A side and a C side of the substrate are collected at the center portion of the substrate (droplets Y). While the droplets Y are swept away along end surfaces of the substrate also from a side of a corner portion (Wa) of the rectangular shaped substrate W, the droplets are collected at the center portion of the substrate. At the center portion of the substrate, an air blowing up from the slit shaped gas injection port of the gas injection mechanism is convergently sprayed on the droplets, while the droplets are accelerated with the help of surface tension on the substrate also, the droplets are blown away to an opposite side to a direction along the carriage of the substrate and removed.

Therefore, finally, persistent droplets attached to both surfaces, edges or corner portions of the rectangular shaped substrate are completely removed by the air even in any kind of glass substrate.

BRIEF DESCRIPTION OF THE DRAWINGS

This and other objects, features and advantages of the present invention will become more apparent upon a reading of the following detailed description and drawings, in which.

DESCRIPTION OF THE EMBODIMENTS

Embodiments of the present invention will be explained.

First, a first embodiment will be explained.

Figure 1:
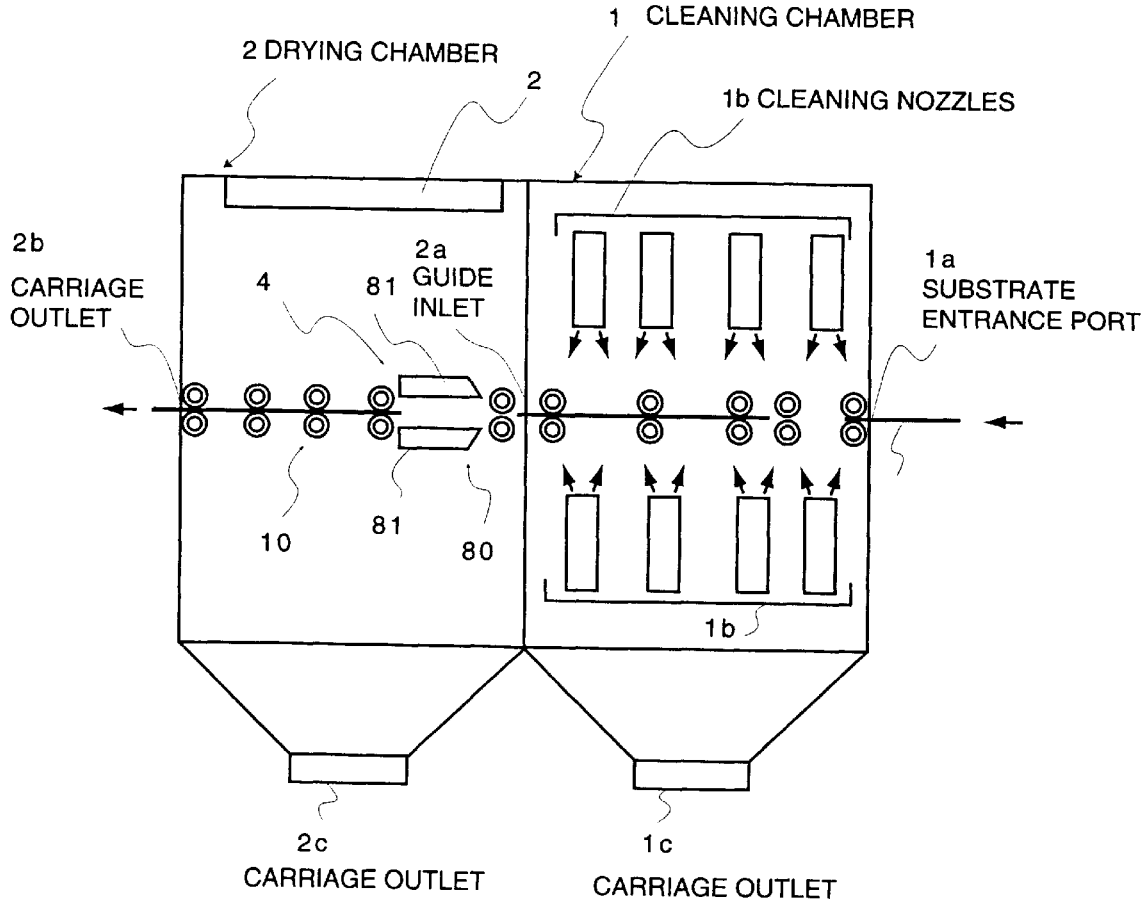
FIG. 1 is a side view showing one example of a cleaning treatment apparatus equipped with a substrate drying apparatus of a first embodiment of the present invention.

FIG. 1 is a side view of a cleaning treatment apparatus provided with a substrate drying apparatus of the present invention.

In FIG. 1, the substrate drying apparatus is disposed within a drying chamber 2 placed adjacently to a cleaning chamber 1.

In the cleaning chamber 1 of the cleaning treatment apparatus, the rectangular shaped substrate W is cleaned by spraying demineralized water of a pressure 3–5 kg/cm and so forth thereon by means of cleaning nozzles 1*b*.

In a side wall of the cleaning chamber 1, which is opposite to the drying chamber 2, of side walls of the cleaning treatment apparatus, an entrance port 1*a* from which the rectangular shaped substrate W enters the cleaning chamber is disposed. In a partition wall between the cleaning chamber 1 and the drying chamber 2 in the cleaning treatment apparatus, a guide inlet 2*a* is disposed for introducing the rectangular shaped substrate W from the cleaning chamber 1 to the drying chamber 2. In a side wall on an exit side of the drying chamber 2 in the cleaning treatment apparatus, a carriage outlet 2*b* is respectively disposed for taking out the rectangular shaped substrate W.

Also, in the cleaning treatment apparatus, a carriage path of the rectangular shaped substrate is constructed so that the rectangular shaped substrate W that is thrown into at a carriage speed of 0.5–1 m/min from the entrance port 1*a* is carried to the carriage outlet 2*b* through the guide inlet 2*a* by a carriage mechanism 10.

A plurality of cleaning nozzles 1*b* are provided with the cleaning chamber 1, which sandwich the carried rectangular shaped substrate W and are opposed to each other up and down, and the cleaning chamber is constructed so that cleaning liquid, such as demineralized water and so forth that has been supplied at a pressure 3–5 kg/cm from a cleaning liquid supply source not shown in the figures is jetted from each nozzle 1*b*, and unnecessaries and so forth attached to both surfaces of the rectangular shaped substrate W are washed out. In addition, under the cleaning chamber 1, a discharge port 1*c* is provided for discharging the unnecessaries removed from the rectangular shaped substrate W together with the cleaning liquid. Also, the carriage mechanism 10 for horizontally carrying the rectangular shaped substrate W along the above-described carriage path is the same as that of the drying chamber 2 mentioned later, and the explanation thereof is omitted here.

Figure 2:
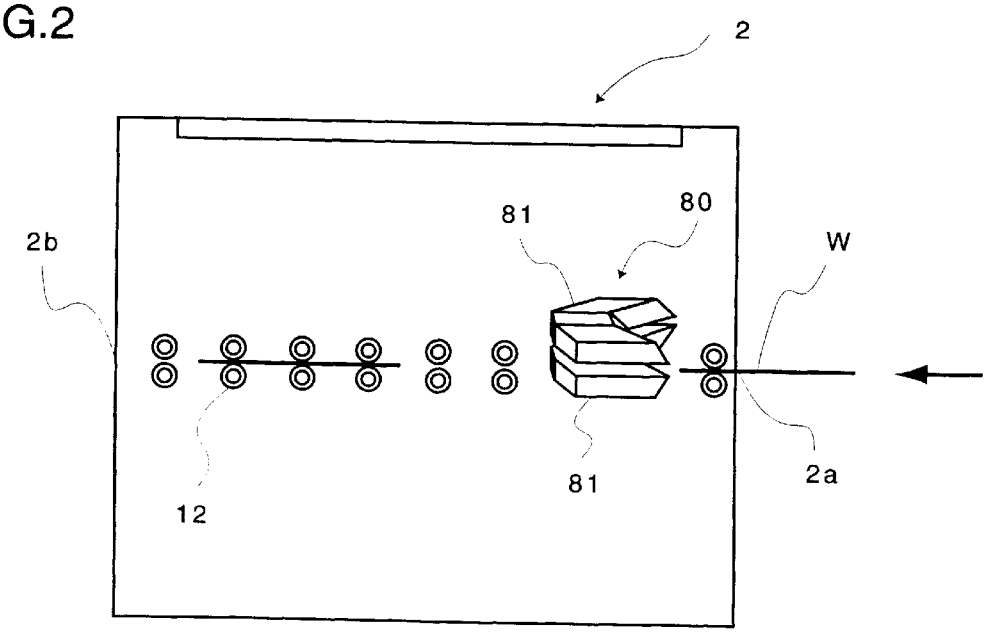
FIG. 2 is a side view showing the substrate drying apparatus of the first embodiment of the present invention.
Figure 3:
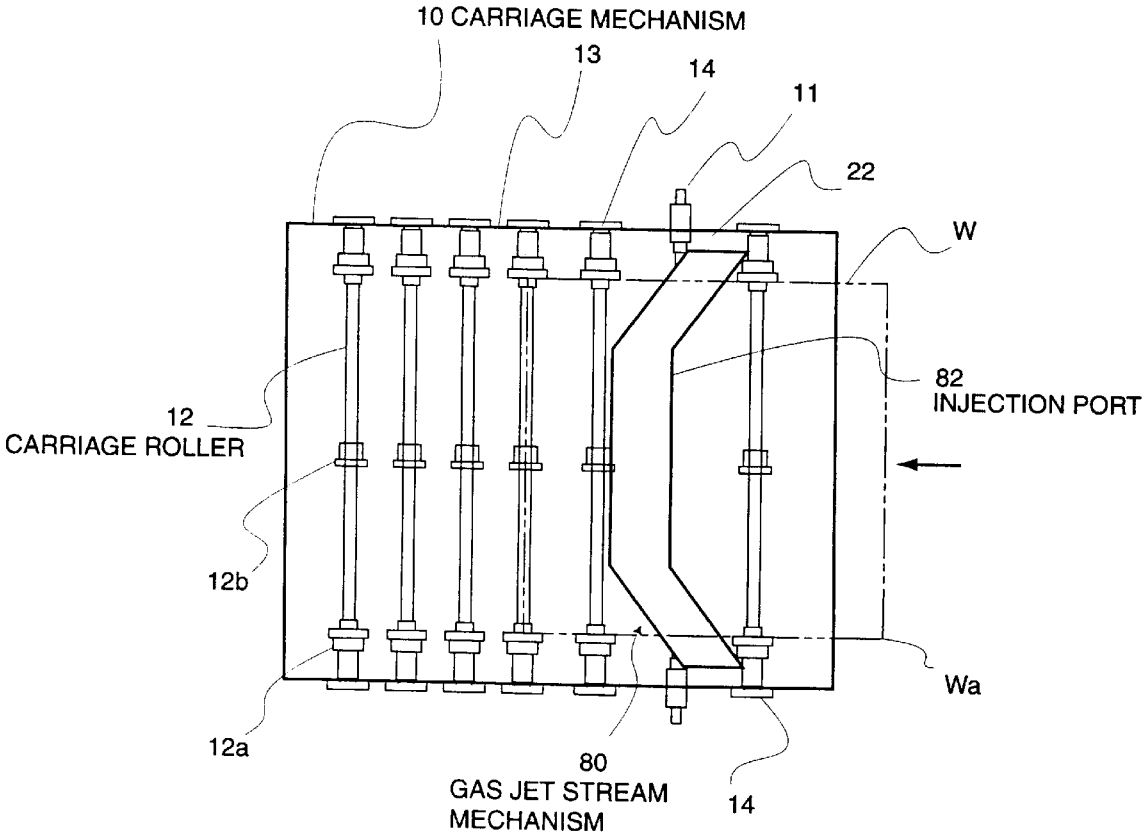
FIG. 3 is a plane view showing an air knife used in the first embodiment of the present invention.

Next, an arrangement of the substrate drying apparatus provided inside the drying chamber 2 will be explained. FIG. 2 is a side view of the substrate drying apparatus and FIG. 3 is a plane view of the substrate drying apparatus. The substrate drying apparatus 4 inside the drying chamber 2 in FIG. 1 is constructed of the carriage mechanism 10 for carrying the rectangular shaped substrate W in a horizontal direction at a speed of 0.5–1 m/min and a discharge port 2*c* for discharging droplets after cutting a liquid thereof. The arrangement of each component will be explained in detail below.

A gas injection mechanism 80 has a pair of air knives 81 that sandwich the carried rectangular shaped substrate W and are placed oppositely to each other up and down. Each of up-and-down air knives 81 is integrally constructed by putting plate members upon each other so as to be formed to taper off to a tip thereof, and a gas injection port 82 formed in the shape of a slit is provided with the tip (FIG. 3).

Also, the slit shaped gas injection port 82 is a portion from which a high pressured air of 3–5 kg/cmsupplied from a gas supply source not shown in the figures is blown up.

The gas injection port 82 of the air knives 81 is constructed so that a slit width of the tip is precisely adjusted to be 0.2–0.3 mm, and precision of a gap thereof requires ±0.05 mm. In order for the air to blow up uniformly and in a constant direction, the above-described precision is necessary, and the construction is adopted that the gas blows up uniformly over an entire surface of the rectangular shaped substrate W in a direction orthogonal to a carriage direction.

A gas jet stream mechanism has a slit shaped gas injection port for jetting the gas toward the surfaces of the substrate carried by the above-described carriage means, and the above-described slit shaped gas injection port is an opening toward directions along which droplets are pushed aside from both sides of end portions of the substrate to a center portion.

Figure 4A:
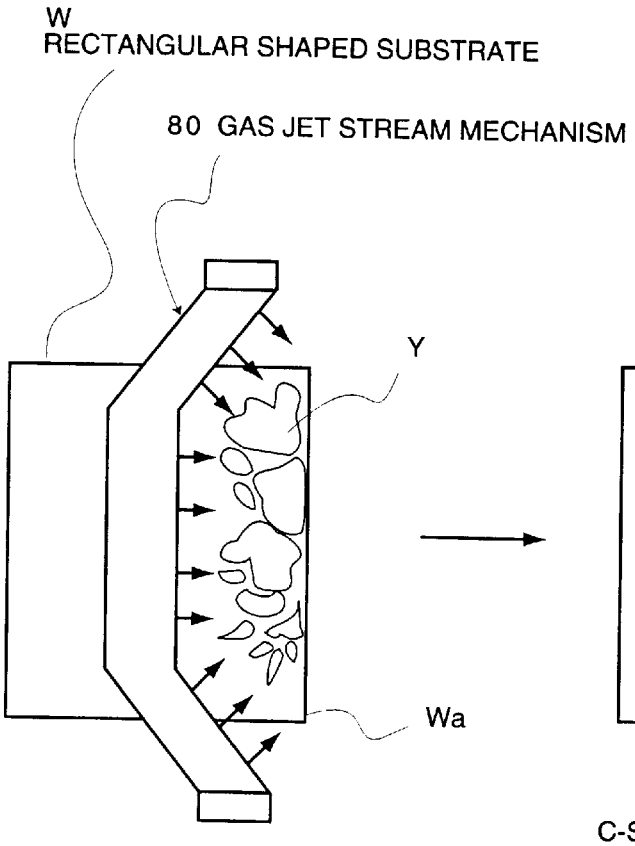
FIG. 4 is a plane view showing operation of the air knife used in the first embodiment of the present invention.
Figure 4B:
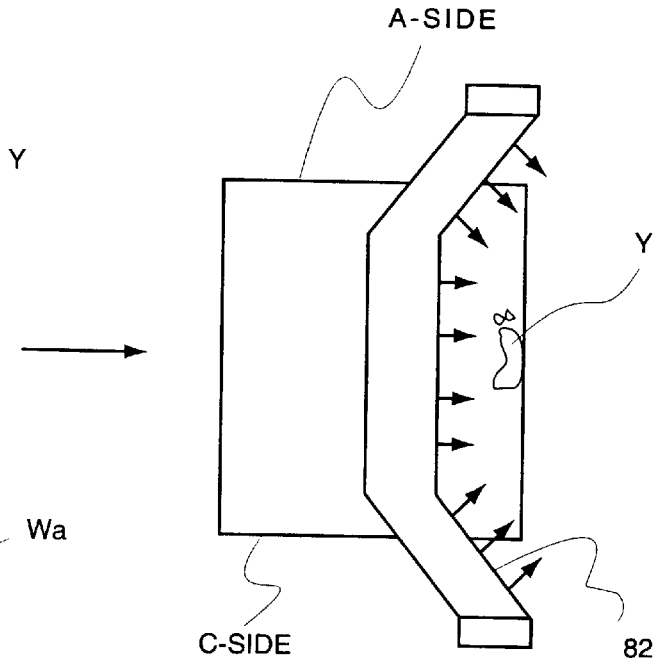

Particularly, in the air knives 81, as shown in FIG. 4, the slit shaped gas injection port 82 is constructed of a linear portion arranged in a direction orthogonal to a direction along the carriage of the substrate W and bent portions bending from and connected to both ends of the linear portion. Also, the bent portions of the above-described slit shaped gas injection port 82 bend to the inside (the side opposite to a direction along the carriage of the substrate) with respect to an extended line of the above-described linear portion. And, while droplets attached to edges, an A side and a C side of the rectangular shaped substrate W are blown away and pushed up on both upper and lower surfaces of the substrate by a high pressured gas flow jetted from the slit shaped gas injection port 82, the attached droplets are collected on both sides of the substrate. The droplets pushed up on the upper and lower surfaces of the substrate are collected at one place to be blown away to an opposite side (along arrows in FIG. 4) to a direction along the carriage of the rectangular shaped substrate W.

In addition, the droplets that have been blown away are taken out through a carriage outlet 2*c* (FIG. 1) disposed in a lower portion of the drying chamber 2. As shown in FIG. 1, the up-and-down air knives 81 for drying the substrate are constructed between body frames 13 through a pair of attachment members 22 (FIG. 3) under horizontal condition with respect to a direction orthogonal to the carriage direction in a horizontal plane.

More particularly, the air from the slit shaped gas injection port 82 of the air knives 81 shown in FIG. 1 is jetted to an opposite side to a direction along the carriage of the substrate and in parallel from the linear portion orthogonal to the direction along the carriage of the rectangular shaped substrate W, and the air is jetted toward a center portion from the substrate end portions to be at an angle θ=about 30°–60° from the bent portions bending from and connected to both ends of the linear portion.

Therefore, by the high pressured gas flow jetted from the slit shaped gas injection port 82 in FIG. 4, the droplets attached to the edges, the A side and C side of the rectangular shaped substrate W are blown away to an opposite side to a direction along the carriage of the substrate and, at the same time, are blown away while being collected at the center portion of both surfaces of the substrate W.

The droplets attached to both upper and lower surfaces of the substrate are collected at the center portion of the substrate while being swept away to an opposite side to a direction along the carriage of the rectangular shaped substrate W and the droplets become to be blown away from the substrate at the center portion of the substrate ends, and thereby, the droplets are completely removed. Also, with regard to the high pressured gas flow jetted to the substrate edges, the A side and C side from the gas injection port 82 in FIG. 4, it is most preferable that the high pressured gas flow is sprayed such that a spray angle with respect to a direction orthogonal to the carriage direction is within an angle θ=15°–45°.

By providing the substrate drying apparatus of the first embodiment of the present invention described above, while a length of a drying portion of a conventional apparatus is about 1.5 m, the length can be about one third, 0.5 m because of miniaturizing an apparatus. Moreover, by saving a space, a cost of the apparatus can be reduced by about 2 millions of yens. Also, it is possible to provide an apparatus capable of reducing an amount of use of required power. Furthermore, although conventionally around 300 m ofia high pressured air which costs 10 of yens per m used for one lot, since two air knives are replaced by one air knife, an amount of the use becomes to be one second, and a cost of the amount of use of the high pressured air can be reduced by about 1500 of yens per lot.

Next, operation will be explained. As shown in FIG. 1, demineralized water and so forth of a pressure 3–5 kg/cmis sprayed on the rectangular shaped substrate W by the cleaning hozzles 1*b* in the cleaning chamber 1, and removal of unnecessaries that have been attached is conducted.

Next, the operation will be explained by referring to FIG. 4. FIG. 4 is a view showing condition until the droplets are removed. As shown in FIG. 4, the droplets attached to entire surfaces of both upper and lower surfaces of the rectangular shaped substrate W are pushed up from the substrate end surfaces to the upper and lower surfaces and, at the same time, are removed while being blown away. After the droplets are removed, they are carried along the carriage path of the rectangular shaped substrate. As the droplets of the rectangular shaped substrate W are swept away to the center portion from the substrate end surfaces, an attachment force of the droplets are weakened, and the droplets are blown away from the rectangular shaped substrate W. The droplets that have been blown away are discharged from the carriage outlet 2*c*.

In addition, also with regard to second and third embodiments explained below, the shape of respective air knives is only changed and the same advantage can be effected.

In addition, although, in the first embodiment, the respective air knives are placed on the upper surface and lower surface of the substrate that are horizontally held so as to form one stage with respect to the carriage direction, the present invention is not limited to this placement. For example, the gas injection mechanism may be constructed so that respective two stages of air knives are placed on both upper and lower surfaces so as to completely conduct liquid cutting (However, the backward stage forms a small-sized drying device.). Also, by using a combination of two stages in which straight air knives are set at a backward stage and the gas injection mechanism of the embodiment of the present invention is set at a forward stage, liquid cutting can be completely conducted.

Next, a second embodiment will be explained.

Figure 5:
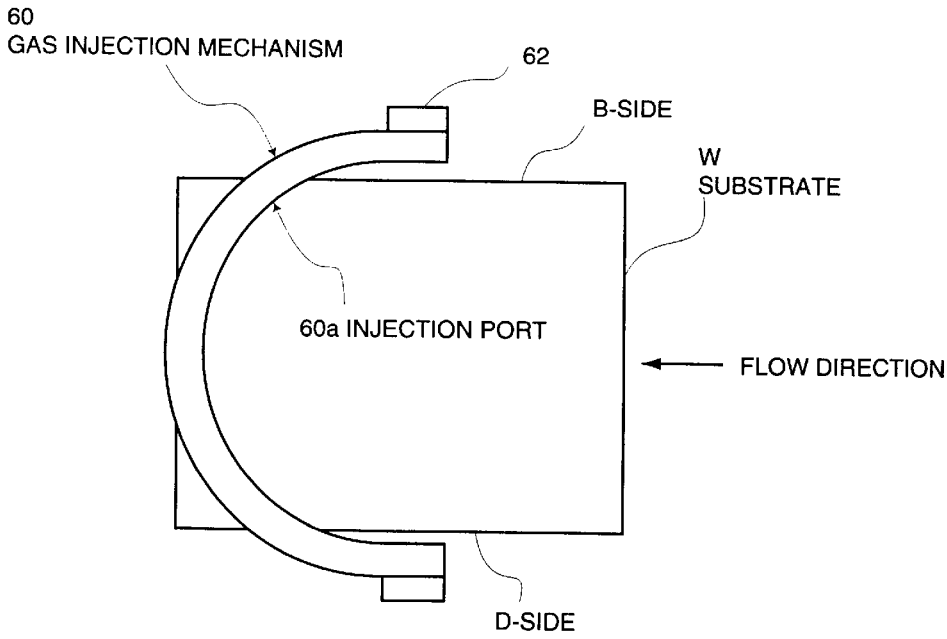
FIG. 5 is a plane view showing an air knife in a second embodiment of the present invention.

FIG. 5 is a view for explaining a gas jet stream mechanism in the second embodiment.

In addition, since other arrangements are the same as those of the first embodiment, the explanation of the arrangements will be omitted here.

A substrate drying apparatus of the second embodiment has the same arrangement as that of the first embodiment in that the apparatus is placed inside the drying chamber 2.

A slit shaped gas injection port 60*a* of a gas jet stream mechanism 60 in a substrate drying apparatus of the second embodiment curves in the shape of a semicircular arc.

A process of conducting liquid cutting of the carried rectangular shaped substrate W by high pressured air knives is totally the same. Also, although, in the gas jet stream mechanism 60, the shape of air knives is the semicircular arc (a letter of C, FIG. 5), all of a blow-up angle of an air, an angle at which an air is sprayed on the substrate end surfaces, precision of a gap at a tip of the air knives and so forth other than the shape of the air knives are the same as in the first embodiment.

Next, a third embodiment will be explained.

Figure 6:
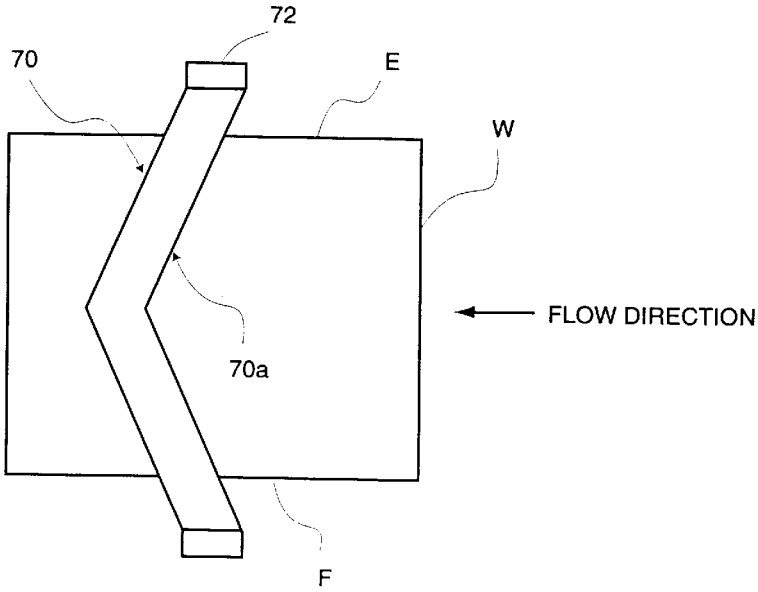
FIG. 6 is a plane view showing an air knife in a third embodiment of the present invention.
Figure 7:
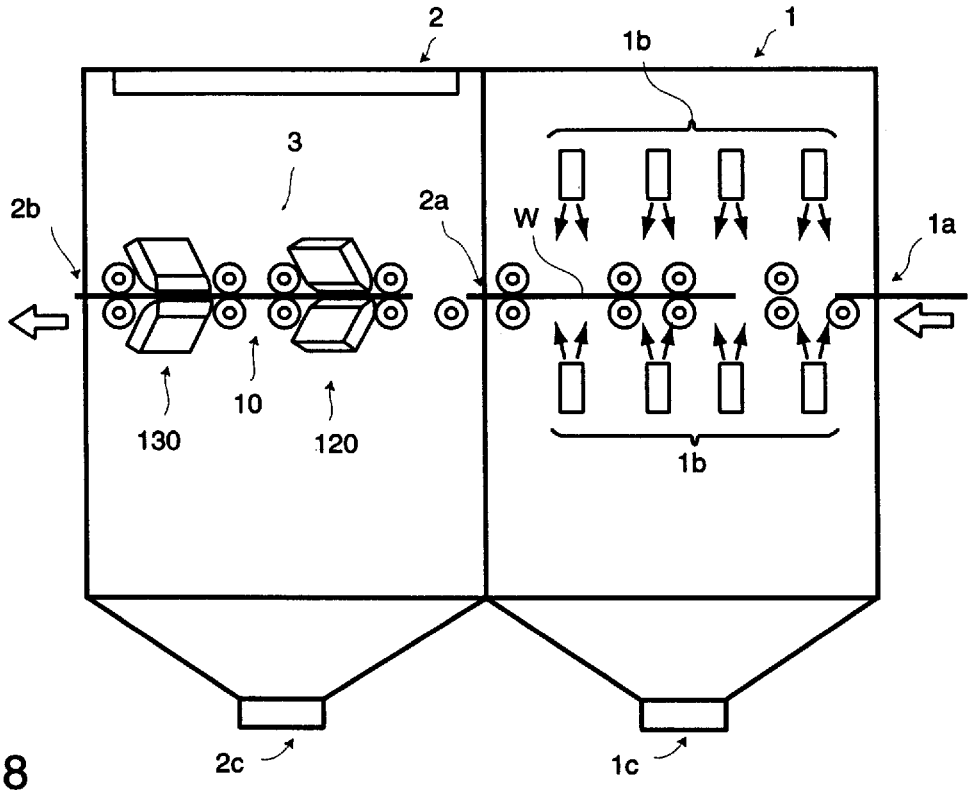
FIG.7 PRIOR ART
FIG. 7 is a side view showing a cleaning apparatus provided with a substrate drying apparatus of a conventional example.
Figure 8:
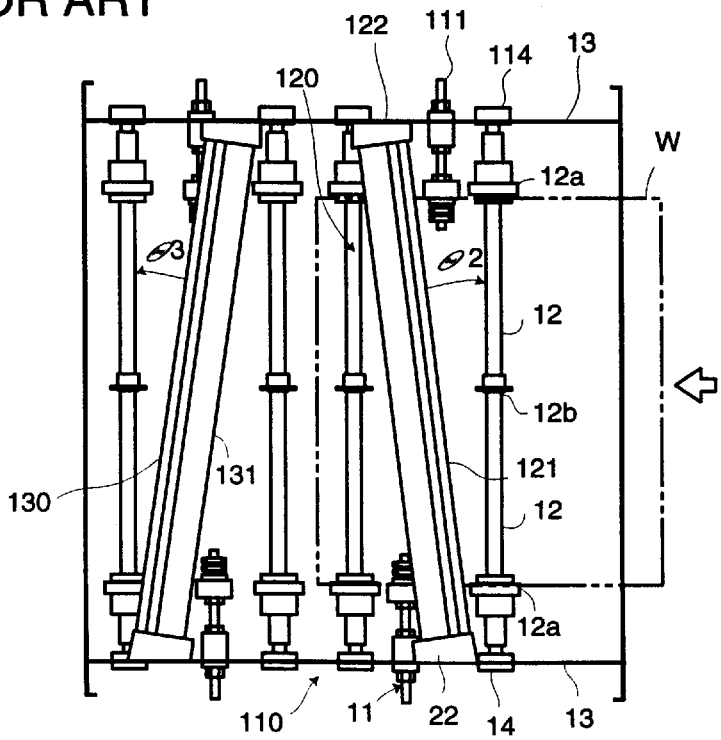
FIG.8 PRIOR ART
FIG. 8 is a plane view showing air knives of a conventional example.
Figure 9:
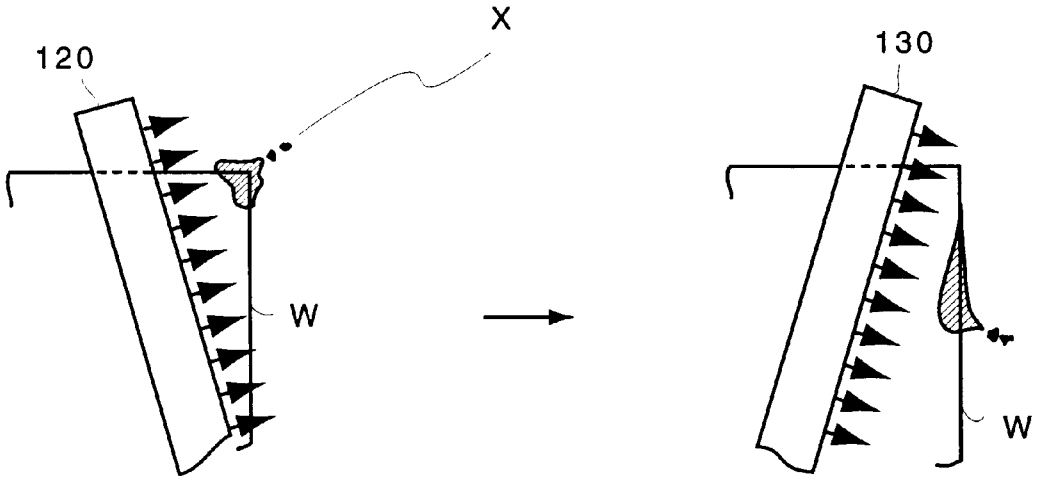
FIG.9 PRIOR ART
FIG. 9 is a plane view showing operation of the air knives of the conventional example.

FIG. 6 is a view for explaining a gas jet stream mechanism in the third embodiment.

A slit shaped gas injection port 70*a* of a gas jet stream mechanism 70 in a substrate drying apparatus of the third embodiment is bent in the shape of a Japanese letter < at a center portion of the substrate.

A process of conducting liquid cutting of the carried rectangular shaped substrate W by high pressured air knives is totally the same. Also, although the gas jet stream mechanism 70 is bent in the shape of the Japanese letter < (a letter of V, FIG. 6) at a center portion of the substrate, all of a blow-up angle of an air, an angle at which an air is sprayed on the substrate end surfaces, precision of a gap at a tip of the air knives and so forth other than the shape of the gas jet stream mechanism are the same as in the first embodiment.

With regard to advantage effected by the second and third embodiments, the same advantage as in the first embodiment can be effected. However, when manufacturing and processing the air knives, an example in which the processing is performed most easily and a processing cost is cheap is a case, as in the third embodiment, that the gas injection port of the air knives is to be in the shape of a letter V as shown in FIG. 6.

As explained above, in accordance with the present invention, since a gas from the gas injection port of the gas injection mechanism is jetted toward the center portion from both end portions of the substrate, persistent droplets attached to the substrate can be completely removed and occurrence of a stain due to remains of the droplets can be prevented, whereby occurrence of particles or hindrance during forming an element can be controlled before happens.

Furthermore, since the droplets attached to both surfaces of the substrate are blown away toward an opposite side to the carriage direction, the droplets do not enter a treatment reservoir at a backward stage, and thereby, it is possible to improve a yield of a product.

The entire disclosure of Japanese Patent Application No. 9-079886 filed on Mar. 31, 1997 including specification, claims, drawing and summary are incorporated herein by reference in its entirety.

What is claimed is:

1. A substrate drying apparatus for spraying a gas on surfaces of a rectangular shaped substrate to which a wet surface treatment has been applied, removing droplets on said surfaces of said substrate, and drying said substrate, comprising:

carriage means for carrying said substrate of an object to be treated; and gas jet stream means having a slit shaped gas injection port for jetting a gas toward said surfaces of said substrate carried by said carriage means, wherein said slit shaped gas injection port is opened toward directions along which droplets are pushed aside from both sides of end portions to a center portion of said substrate.

2. A substrate drying apparatus according to claim 1, wherein said slit shaped gas injection port of said gas jet stream means is constructed of a linear portion arranged in a direction orthogonal to a direction along carriage of said substrate and bent portions bending from and connected to both ends of said linear portion.

3. A substrate drying apparatus according to claim 2, wherein said bent portions bend to an inside with respect to an extended line of said linear portion.

4. A substrate drying apparatus according to claim 3, wherein said bent portions are connected to said linear portion so as to be at an angle 30°–60° with respect thereto.

5. A substrate drying apparatus according to claim 3, wherein said bent portions are constructed so that a high pressured gas flow jetted to substrate edges is sprayed with a spray angle with respect to a direction orthogonal to a direction along said carriage that is in a range of an angle 15°–45°.

6. A substrate drying apparatus according to claim 2, wherein a slit width of said slit shaped gas injection port of said gas jet stream means is 0.2–0.3 mm.

7. A substrate drying apparatus according to claim 2, wherein an air of 3–5 kg/cmis blown up from said slit shaped gas injection port of said gas jet stream means.

8. A substrate drying apparatus according to claim 1, wherein said slit shaped gas injection port of said gas jet stream means curves in a shape of a semicircular arc.

9. A substrate drying apparatus according to claim 1, wherein said slit shaped gas injection port of said gas jet stream means is bent in a shape of a Japanese letter < at a center portion of said substrate.

10. A substrate drying apparatus for spraying a gas on surfaces of a rectangular shaped substrate to which a wet surface treatment has been applied, removing droplets on said surfaces of said substrate, and drying said substrate, comprising:

carriage means for carrying said substrate of an object to be treated; and gas jet stream means having a slit shaped gas injection port for jetting a gas toward said surfaces of said substrate carried by said carriage means, wherein said slit shaped gas injection port has a linear portion arranged in a direction orthogonal to a direction along carriage of said substrate, and bent portions bent to an inside with respect to an extended line of said linear portion and connected to both ends of said linear portion, and said linear portion and said bent portions are opened toward directions along which droplets are pushed aside from both sides of end portions to a center portion of said substrate.

11. A substrate drying apparatus for spraying a gas on surfaces of a rectangular shaped substrate to which a wet surface treatment has been applied, removing droplets on said surfaces of said substrate, and drying said substrate, comprising:

carriage means for carrying said substrate of an object to be treated; and gas jet stream means having a slit shaped gas injection port for jetting a gas toward said surfaces of said substrate carried by said carriage means, wherein said slit shaped gas injection port curves in a shape of a semicircular arc and is opened toward directions along which droplets are pushed aside from both sides of end portions to a center portion of said substrate.

12. A substrate drying apparatus for spraying a gas on surfaces of a rectangular shaped substrate to which a wet surface treatment has been applied, removing droplets on said surfaces of said substrate, and drying said substrate, comprising:

carriage means for carrying said substrate of an object to be treated; and gas jet stream means having a slit shaped gas injection port for jetting a gas toward said surfaces of said substrate carried by said carriage means, wherein said slit shaped gas injection port is bent in a shape of a Japanese letter < at a center portion of said substrate and is opened toward directions along which droplets are pushed aside from both sides of end portions to a center portion of said substrate.

13. A substrate drying method of spraying a gas on surfaces of a rectangular shaped substrate to which a wet surface treatment has been applied, removing droplets on said surfaces of said substrate, and drying said substrate, comprising steps of:

carrying said substrate of an object to be treated; and jetting a gas toward directions along which droplets are pushed aside from both sides of end portions to a center portion of said carried substrate and jetting a gas toward a direction along which said droplets collected at said center portion of said substrate are pushed aside opposite to a direction along carriage of said substrate.

* * * * *